United States Patent [19]

Hoffman et al.

[11] Patent Number: 4,786,005

[45] Date of Patent: Nov. 22, 1988

[54] APPARATUS FOR DISPENSING SHEET MATERIAL

[75] Inventors: Louis S. Hoffman, Morristown; William Bohmer, Flanders; Ralph J. DeVito, Bound Brook; Brian R. Langille, Great Meadows; Richard D. Watkins, Whippany; Charles B. Sanders, Cedar Grove; Martha E. Kerch, Flanders; Marc Shanko, Cedar Nolls, all of N.J.

[73] Assignee: Scott Paper Company, Philadelphia, Pa.

[21] Appl. No.: 32,117

[22] Filed: Mar. 27, 1987

Related U.S. Application Data

[62] Division of Ser. No. 798,552, Nov. 15, 1985, Pat. No. 4,666,099.

[51] Int. Cl.[4] ..... B65H 19/00; B25C 5/02

[52] U.S. Cl. ..... 242/55.53; 226/127; 226/188; 312/38

[58] Field of Search ..... 226/127, 188; 242/55.53, 55.2; 312/38–41

[56] References Cited

U.S. PATENT DOCUMENTS

| | | | |
|---|---|---|---|
| 3,327,901 | 6/1967 | Yerkovich . | |
| 3,563,623 | 2/1971 | Walton | 312/38 |
| 3,576,277 | 4/1971 | Blackmon | 222/1 |
| 3,951,485 | 4/1976 | Schnyder et al. | 242/55.53 X |
| 4,349,133 | 4/1982 | Christine . | |

FOREIGN PATENT DOCUMENTS

| | | |
|---|---|---|
| 78181 | 5/1983 | European Pat. Off. . |
| 110686 | 6/1984 | European Pat. Off. . |
| 127497 | 12/1984 | European Pat. Off. . |
| 2016862 | 5/1970 | France . |
| 2227688 | 11/1974 | France . |
| 2541244 | 2/1983 | France . |

*Primary Examiner*—David Werner

*Attorney, Agent, or Firm*—Caesar, Rivise, Bernstein, Cohen & Pokotilow, Ltd.

[57] ABSTRACT

The disclosure relates to an apparatus for dispensing sheet material such as paper towels. The dispensing apparatus when activated dispenses sheet material for a predetermined time which results in a predetermined length of sheet material being dispensed. The dispensing apparatus is actuated in response to the proximity of a portion of a hand of a user to the dispensing apparatus without the hand of a user contacting the apparatus. The dispensing apparatus dispenses sheet material from a roll of material by means of an electrical motor operating for a predetermined time to advance a predetermined length of the sheet material. The motor for advancing a predetermined length of the sheet material can be battery powered. The housing of the dispensing apparatus has a modular frame having a first compartment for the means for advancing the sheet material and a second compartment for the means for activating the advancing means. The dispensing apparatus can include means for storing energy for energizing the advancing means in response to the withdrawal of sheet material from the dispensing apparatus by a user.

16 Claims, 7 Drawing Sheets

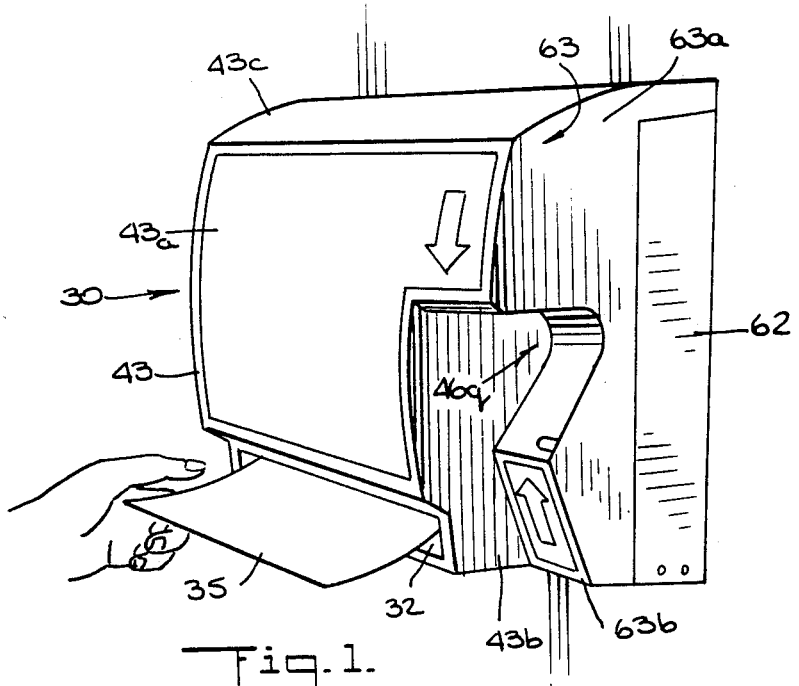
Fig. 1.
Fig. 2.
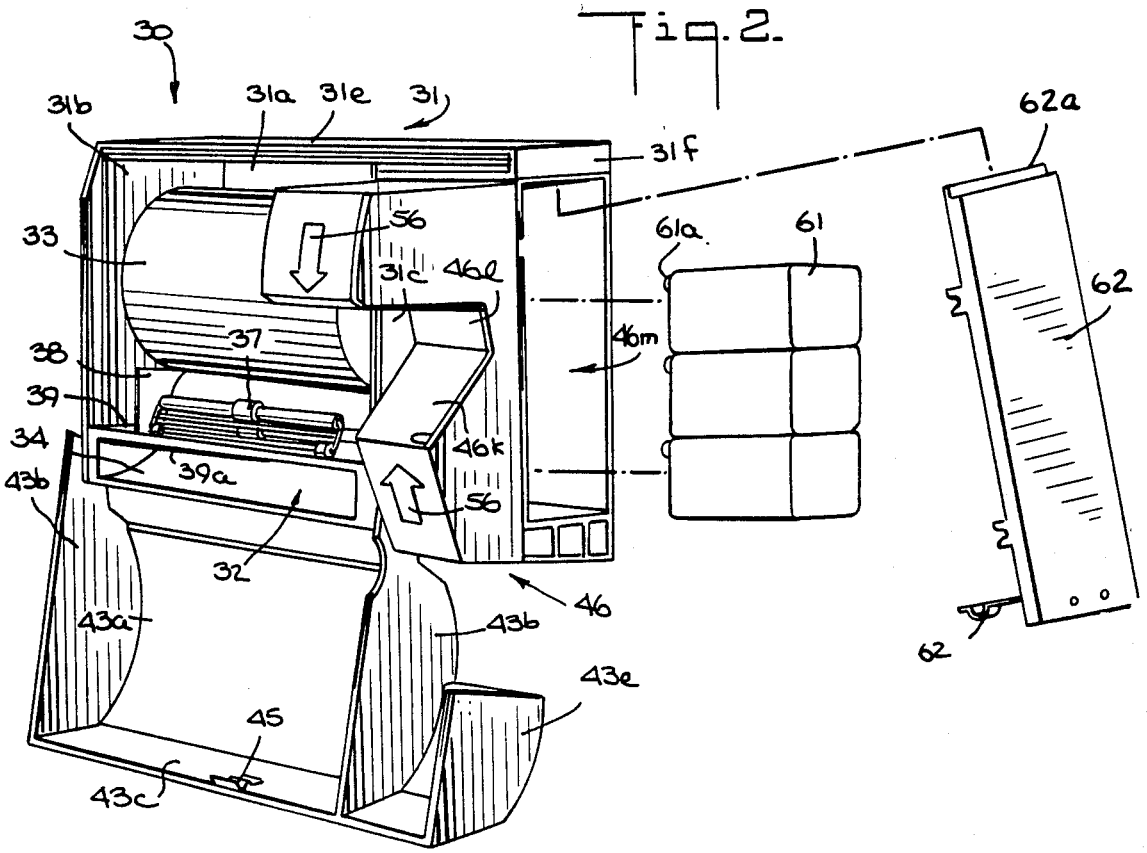

APPARATUS FOR DISPENSING SHEET MATERIAL

RELATED APPLICATION

This application is a divisional application of copending U.S. patent application Ser. No. 798,552, filed on Nov. 15, 1985, and entitled "Method And Apparatus For Dispensing Sheet Material" now U.S. Pat. No. 4,666,099.

BACKGROUND OF THE INVENTION

1. Field of the Invention

The invention relates to an apparatus for dispensing sheet material such as paper towels. In particular, the invention relates to the dispensing of sheet material for a predetermined time in order to dispense a predetermined length of sheet material. More in particular, the invention relates to the dispensing of sheet material in response to the proximity of a portion of a hand of a user to the dispensing apparatus without contacting the apparatus. The invention further relates to an apparatus for dispensing sheet material from a roll of material with an electrical motor operating for a predetermined time in order to advance a predetermined length of the sheet material from a discharge opening in the housing of the dispensing apparatus.

2. Description of the Prior Art

U.S. Pat. No. 3,301,617, issued Jan. 31, 1967, of Goodwin et al. and U.S. Pat. No. 3,450,363, issued June 17, 1969, of Williams, show dispensers having an electrical motor in response to a button switch held by a user to advance a web of material stored on a roll within the dispenser.

U.S. Pat. No. 3,317,150, issued May 2, 1967 of Summersby and U.S. Pat. No. 3,892,368, issued July 1, 1975, of Richards, show dispensing apparatus in which a battery powered electrical motor drives the web material from the roll as long as a button switch is held by a user.

U.S. Pat. No. 3,951,485, issued Apr. 20, 1976, of Schnyder et al. shows a dispenser for an endless roll of textile towel material in which an electrical motor operates the dispensing apparatus and in which a light responsive unit or a proximity switch initiates the operation of the dispensing apparatus to dispense a predetermined length of towel material.

SUMMARY OF THE INVENTION

An object of the invention is to provide an apparatus for dispensing sheet material in which the apparatus advances the sheet material for a predetermined length of time to dispense a predetermined length of sheet material.

Another object of the invention is to provide an apparatus for dispensing sheet material in which a battery powered electrical motor is activated for a predetermined length of time to advance a predetermined length of the sheet material.

Still another object of the invention is to provide an apparatus for dispensing sheet material from a roll of material in response to the proximity of a hand of the user with respect to the dispensing apparatus.

An additional object of the invention is to provide a dispensing apparatus for sheet material in which the structure forming the housing of the dispensing apparatus has an open cavity therein adapted to receive a portion of the hand of a user for activating the dispensing apparatus without contact therewith.

A further object of the invention is to provide a dispensing apparatus in which the means for advancing the sheet material, the means for activating the advancing means, and the electrical energy source are integrated in a modular frame which is inserted in the housing of the dispensing apparatus.

It is also an object of the invention to provide a dispensing apparatus in which an edge portion of the sheet material stored within the apparatus is advanced in response to the proximity of a user to enable the user to grasp the edge portion and to withdraw a length of the sheet material from the dispensing apparatus.

In one embodiment of the invention, the apparatus for dispensing sheet material comprises means for activating the means for advancing sheet material for a predetermined period of time to advance a predetermined length of sheet material.

In another embodiment of the invention, the means for advancing the sheet material for a predetermined length of time comprises an electrical motor.

In still another embodiment of the invention, the apparatus for dispensing sheet material comprises a housing having a discharge opening as well as an open cavity adapted to receive a portion of the hand of a user. The apparatus includes means responsive to the proximity of a hand of the user with respect to the open cavity to activate a means for advancing a predetermined length of the sheet material through the discharge opening of the apparatus.

In an additional embodiment of the invention, the means for advancing a predetermined length of the sheet material is battery powered.

In another embodiment of the invention, the housing of the dispensing apparatus comprises a modular frame having a first compartment for the means for advancing the sheet material and a second compartment adjacent the first compartment for the means for activating the means for advancing the predetermined length of sheet material.

In still another additional embodiment of the invention, the dispensing apparatus is provided with means for storing energy for energizing the advancing means for the sheet material in response to the withdrawal of sheet material from the dispensing apparatus by a user.

In a further embodiment of the invention, the stored energy is converted into electrical energy and accumulated within the dispensing apparatus.

BRIEF DESCRIPTION OF THE DRAWINGS

FIG. 1 is a perspective view of the dispensing apparatus of the invention showing a tail of sheet material being advanced from the apparatus;

FIG. 2 is a perspective view of the dispensing apparatus of the invention showing an electrical power source to be installed in the compartment of a modular frame for the housing of the dispensing apparatus;

FIG. 3 is a perspective view of the dispensing apparatus of the invention with the cover in the open position and with the modular frame removed from the auxiliary portion of the housing of the apparatus;

DESCRIPTION OF THE INVENTION

Figure 9:
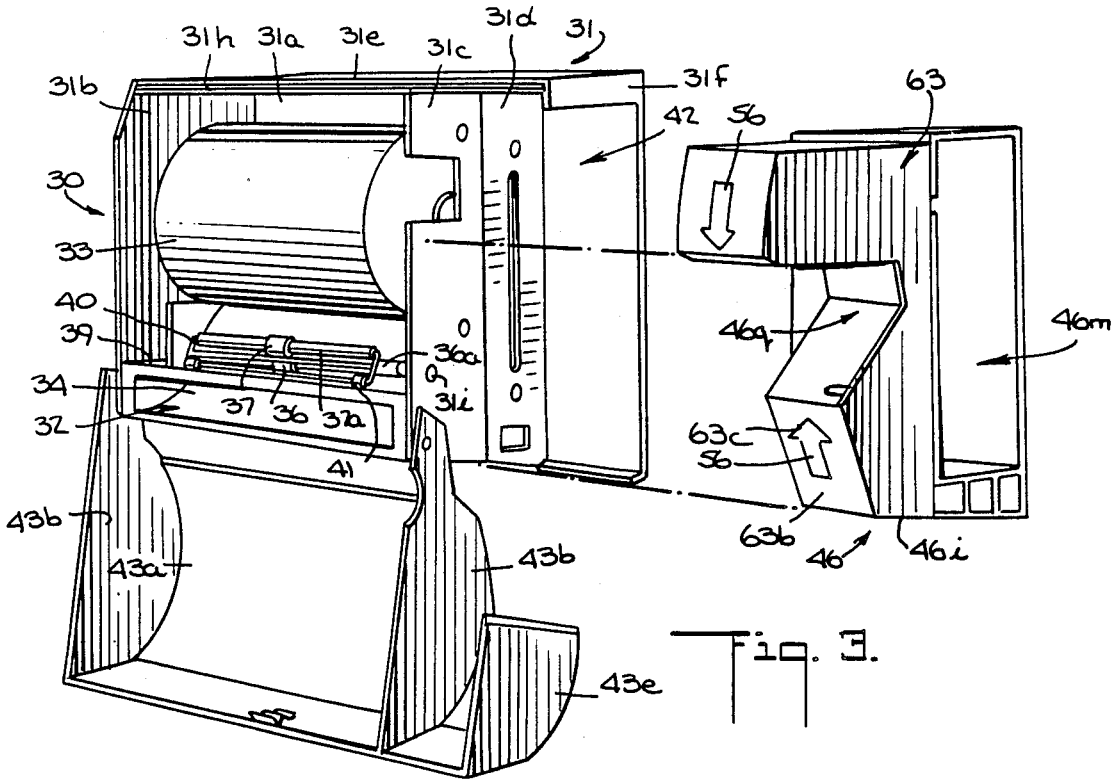
FIG. 9 shows the embodiment of the invention of FIG. 8 when the user is withdrawing sheet material from the dispensing apparatus.

As shown in FIGS. 1, 2, 3 and 4, the dispensing apparatus 30 includes structure forming a housing 31 having a discharge opening 32. Roll 33 of sheet material to be dispensed such as paper towels is disposed within the housing adjacent back wall 31*a* and end walls 31*b* and 31*c*. The lower peripheral portion of roll 33 as viewed in FIG. 2 is disposed above and adjacent to inclined guide 34 which extends to the lower portion of discharge opening 32. When the roll 33 is placed within housing 31, the tail or free end portion 35 of the paper towel is extended between drive roller 36 and pressure roller 37. The drive roller is mounted on shaft 36*a* which is pivotally supported with respect to uprights 38 extending from plate 39 extending above discharge opening 32. Pressure roller 37 is mounted on shaft 37*a* which is pivotally supported by links 40 extending between shafts 37*a* and mounts 41 disposed upon plate 39. Means (not shown) urges the links 40 and thereby shaft 37*a* and pressure roller 37 toward drive roller 36 in order that a nip is formed therebetween which is adapted to receive the tail 35 of the paper towel material.

Top wall 31*e* extends beyond end wall 31*d* of the housing and terminates in flange 31*f*. Similarly back wall 31*a* of the housing extends beyond end wall 31*d* with the lower end portion of the back wall extending beyond the end wall having flange 31*g*. Thus it can be seen that end walls 31*c* and 31*d*, a portion of top wall 31*e* and a portion of back wall 31*a* form a recess 42 at the right side of housing 31 as viewed in FIGS. 3 and 4.

Figure 4:
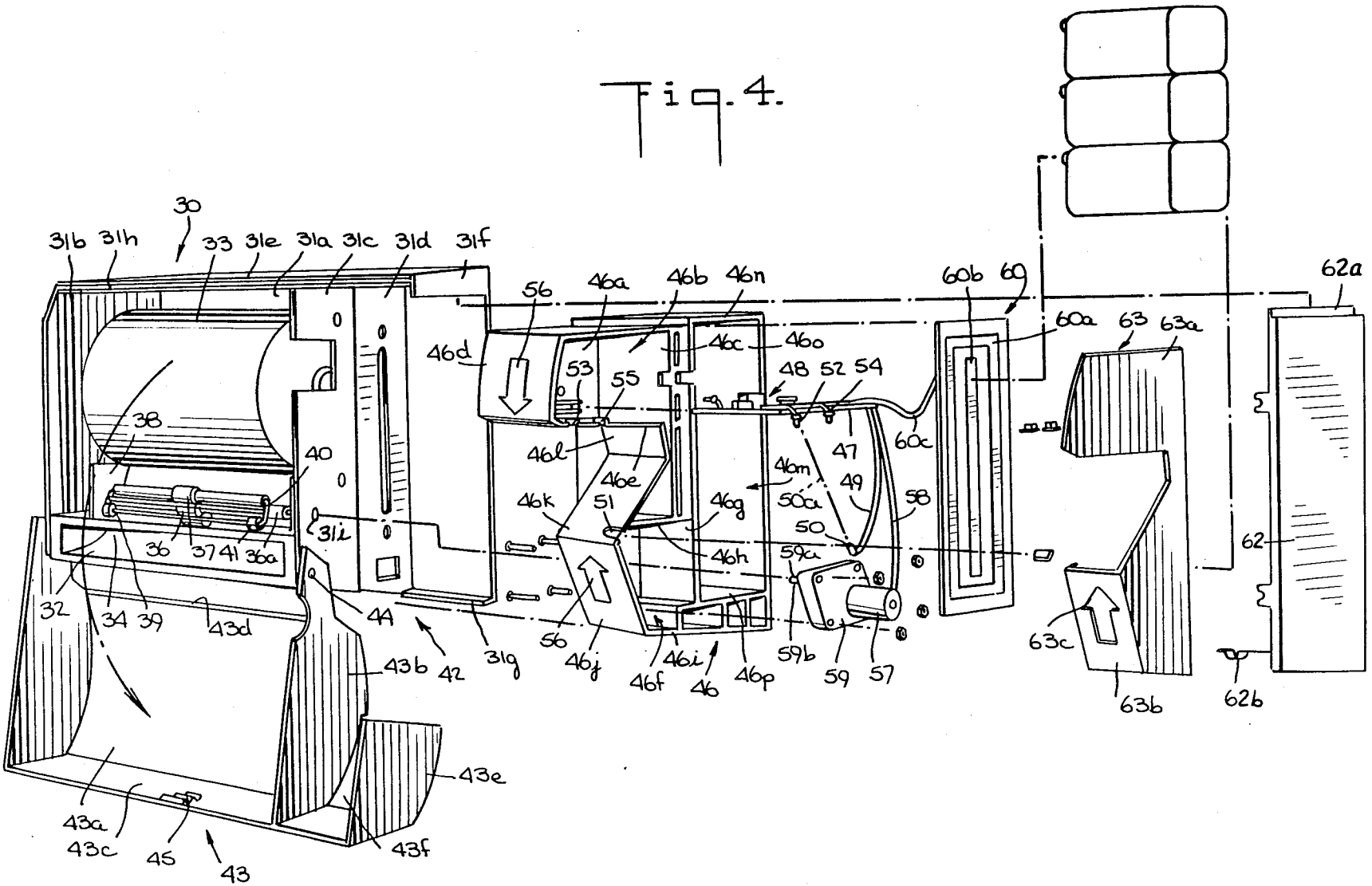
FIG. 4 is a partially exploded perspective view of the dispensing apparatus of the invention showing the elements of the modular frame separated from the housing of the dispensing apparatus.

Cover 43 of housing 31 includes front portion 43*a*, end portions 43*b* and top portion 43*c*. The lower ends of each of end portions 43*b* are pivotally mounted by hinges 44 to end walls 31*b* and 31*c* , respectively, of housing 31. When cover 43 is rotated clockwise as seen in FIG. 3 and 4 to a closed position shown in FIG. 1, spring latch 45 engages front flange 31h to retain the cover 43 in a closed position. When closed, lower edge 43*d* of cover 43 is substantially aligned with front edge 39*a* of plate 39, thereby leaving the cover free of discharge opening 32. Top portion 43*c* of the cover extends beyond the right-hand end portion 43*b* of the cover as viewed in FIGS. 3 and 4 and side plate 43*e* and curved front plate 43*f* are attached thereto.

End walls 31*b*, 31*c* and 31*d*, top wall 31*e* and plate 39 form a main portion within housing 31 in which roll 33 of towel material is adapted to be disposed. The drive roll 36 and the pressure roll 37 which comprise a portion of the means for advancing a predetermined length of the sheet material or towel material through discharge opening 32 are also disposed in the main portion of housing 31. End walls 31*c* and 31*d* and a portion of top wall 31*e* form an auxiliary portion or recess 42 of housing 31 adjacent and at one side of the main portion thereof.

As shown in FIG. 2, the dispensing apparatus 30 of the invention further includes structure forming a modular frame 46 which is adapted to be disposed within the auxiliary portion 42 of housing 31. As shown in FIGS. 3 and 4, modular frame 46 has a side wall 46*a* which is adjacent to and in a facing relationship with end walls 31*c* and 31*d* of the housing when the modular frame is installed within the auxiliary portion of the housing. A first compartment 46*b* extends from side wall 46*a* and includes intermediate wall 46*c*, front wall 46*d* and bottom wall 46*e*.

Modular frame 46 further includes second compartment 46*f* extending from the side wall 46*a* of the modular frame 46 and being formed by second intermediate wall 46*g*, upper wall 46*h*, bottom wall 46*i*, and sloping front wall 46*j*. The second compartment of modular frame 46 is completed by a portion of sloping wall 46*k*, the upper portion of which is connected to bottom wall 46*e* of the first compartment 46*b* by flange 461. Thus, as is shown in FIG. 1, bottom wall 46*e* of the first compartment, flange 461 and sloping wall 46*k* from an open cavity 46*q* extending rearwardly with respect to modular frame 46.

Modular frame 46 includes a third compartment 46*m* having top wall 46*n*, back wall 46*o*, bottom wall 46*p*, with second intermediate wall 46*g* forming the front wall of the third compartment 46*m* . The third compartment 46*m* is adapted to contain a source of electrical energy to energize the advancing means of the dispensing apparatus.

Figure 5:
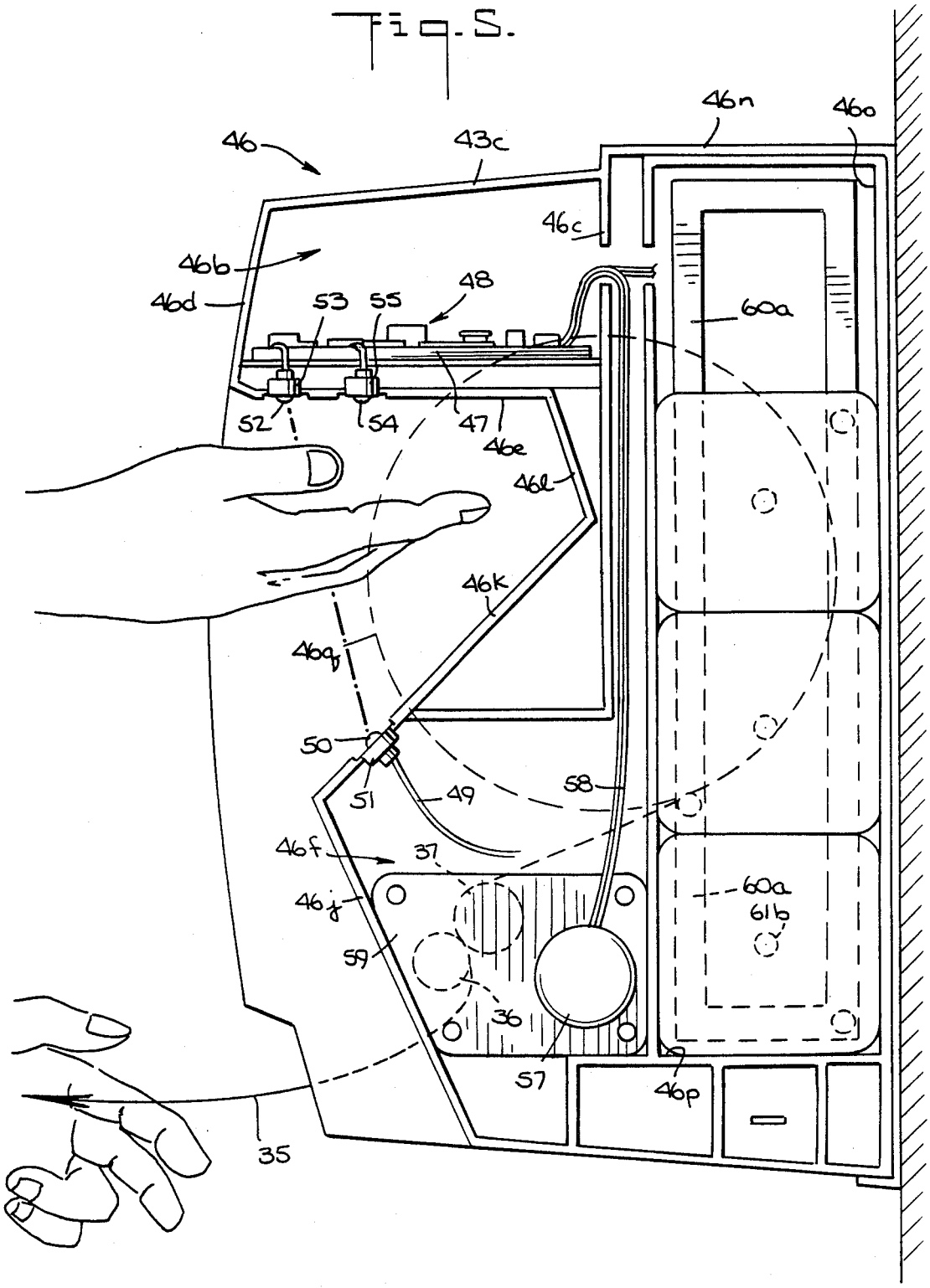
FIG. 5 is a vertical section view of the modular frame of the dispensing apparatus of the invention showing a portion of a hand of a user disposed within the open cavity of the moudlar frame and intersecting the infrared light beam therein.

In FIGS. 4 and 5, printed circuit board 47 bearing control circuitry 48 of the invention is shown mounted adjacent bottom wall 46*e* of the first compartment 46*b* of the modular frame 46. Lead 49 extending from the circuitry on board 47 is connected to a source of electromagnetic radiation such as an infrared light source or light emitting diode 50. Diode 50 is mounted in socket 51 in sloping wall 46*k* of the open cavity formed in the front of the modular frame 46. A sensor of electromagnetic radiation such as a sensor of infrared light from diode 50 comprising phototransistor 52 is mounted on circuit board 47 adjacent the lower surface thereof in order to be exposed to the infrared light emitted by LED 50. Phototransistor 52 extends through socket 53 in bottom wall 46*e* of the first compartment 46*b*.

On the bottom portion of circuit board 47, there is also disposed means for responding to the ambient light comprising phototransistor 54. The phototransistor 54 is mounted in bottom wall 46*e* of first compartment 46*b*. *Accordingly, phototransistor 54 is exposed to the ambient light within the open cavity 46q* at the front portion 46*d* of the modular frame 46. In order to indicate to the user that the means responsive to the proximity of the hand of the user for activating the advancing of a predetermined length of towel material, front wall 46*d* of the first compartment and front wall 46*j* of the second compartment as shown in FIGS. 2, 3 and 4 are provided with arrows 56 which point toward the open cavity 46*q*. Arrow 56 on front wall 46*d* is viewed through a window in front curved wall 43*f* of cover 43.

The means disposed within the housing of the dispensing apparatus for advancing a predetermined length of the towel material through the discharge opening 32 includes electrical motor 57 which is connected to printed circuit board 47 by lead 58 (FIGS. 4 and 5). The motor 57 as shown in FIG. 4 is mounted upon and engaged to gear transmission 59 having output shaft 59*a* in which there is a slot 59*b*. Transmission 59 is mounted upon the lower portion of side wall 46*a* of the modular frame with shaft 59*a* extending through an opening therein. Shaft 59*a* further extends through opening 31*i* in side wall 31*c* with slot 59*b* of shaft 59*a* engaging the right-end portion of shaft 36*a* of drive roller 36. Rotation of shaft 36*a* in a counterclockwise direction as viewed in FIG. 4 by transmission 59 causes tail 35 of the paper towel material to advance away from roll 33 and between drive roll 36 and pressure roll 37 in the direction of discharge opening 32.

The third compartment 46*m* of the modular frame 46 as shown in FIGS. 2, 4 and 5 is adapted to receive contact assembly 60 against side wall 46*a* of the modular frame. Contact assembly 60 includes open rectangular contact 60*a* and strip contact 60*b* . Contact 60*a* is adapted to be engaged by outer terminal 61*a* of a conventional battery such as a six volt lantern battery. Contact 60*b* is adapted to engage the center terminal 61*b* of a conventional battery, again such as a lantern battery. The open rectangular form of contact 60*a* enables it to be engaged by outer terminal 61*a* regardless of the orientation of battery 61 within the third compartment 45*m*. Of course, the center contact 60*d* can always engage the center terminal 61*b* of battery 61 since the center terminal is aligned with contact 60*b* regardless of the orientation of the battery. Lead 60*c* connects the contacts 60*a* and 60*b* to the circuit board 47.

After batteries 61 are installed in the third compartment 46*m* of the modular frame 46, cover 62 can be installed (FIGS. 2 and 4). The cover includes flange 62*a* which is adapted to engage flange 31*f* to the modular frame 46. Cover 62 also includes spring clip 62*b* which is adapted to maintain the cover in the closed position.

Cover 62 (FIG. 4) having side wall 63*a* and front wall 63*b* is adapted to cover first compartment 46*b* and second compartment 46*f*. Front wall 63*b* contains window 63*c* which permits arrow 56 to be exposed when cover 62 is in place.

Figure 6:
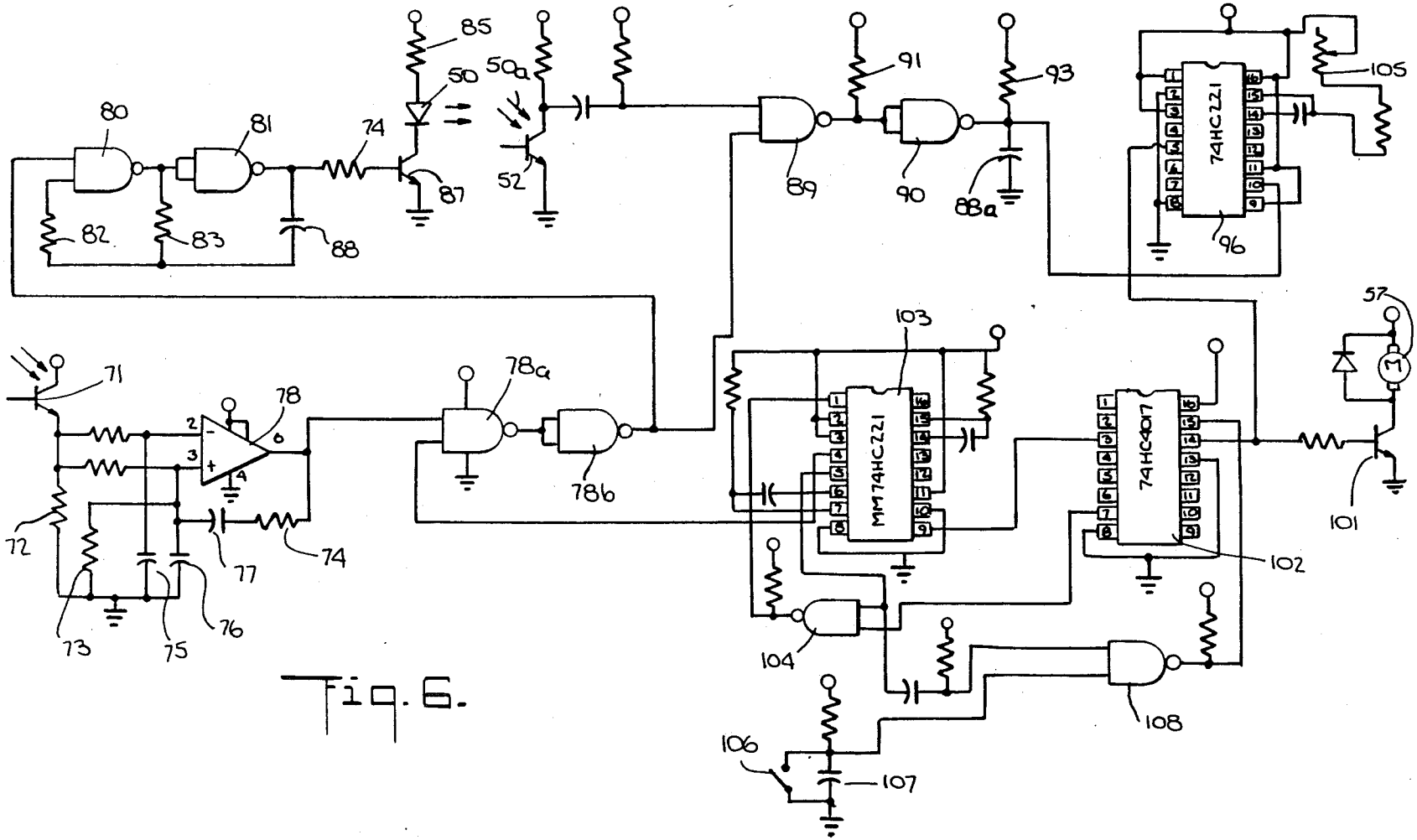
FIG. 6 is a schematic diagram of the electrical circuitry of the invention.

The electrical circuitry 48 of the invention is shown in FIG. 6. As shown in FIG. 5, the positioning of the fingers of the user in the open cavity 46*q* of modular frame 46 beneath sensor 54 reduces the level of ambient light to which the sensor is exposed. Accordingly, the sensing of the change in ambient light by sensor 54 can be used to activate the circuitry for driving 57 (FIG. 6) of the dispensing apparatus 30 which includes the means for activating the means for advancing the paper towel material through the discharge opening 32 for a predetermined period of time. Phototransistor 71, resistors 72, 73, and 74, capacitors 75, 76 and 77, and integrated circuit 78 form a differential comparator having a predetermined time constant. By way of example, the time constant can be approximately five seconds. Phototransistor 71 can comprises an MRD370 phototransistor. Integrated circuit 78 can comprise a TLC251 integrated circuit. The circuit is always in an energized state with phototransistor 71 constantly sensing the level of ambient light adjacent the open cavity 46*q* of the dispensing apparatus. Even though the phototransistor 71 is always energized, ambient light keeps collector-emitter circuit of phototransistor 71 turned off with the result that the output of integrated circuit 78 is low.

When phototransistor 71 senses a drop in the ambient light level as when a user places his hands within the open cavity 46*q* of the modular frame 46 of the dispensing apparatus 30, the input to integrated circuit 78 from phototransistor 71 goes low. As a result, the output of integrated circuit 78 goes high, the output of integrated circuit 78*a* goes low, and the output of integrated circuit 78*b* goes high. Integrated circuits 78*a* and 78*b* are nand gates which, by way of example, are each one-quarter of a quadruple input positive nand gate such as a 74HC00.

The infrared light source 50 comprises a light-emitting diode, i.e., an LED. By way of example, LED source 50 can comprise a TIL906-1 light emitting diode. Nand gates 80 and 81, resistors 82, 83, 84 and 85, as well as capacitor 88 are connected to transistor 87. Transistor 87 in turn drives the light emitting diode or LED 50. By way of example, each nand gate 80 and 81 can comprise one-quarter of a quadruple 2-input positive nand gate, such as a 74CH00. Transistor 87 in series with the LED 50 can, by way of example, be a MPS A13. Due to the feedback of capaqcitor 88 and nand gates 80 and 81, the input signal to transistor 87 is a series of pulses. In turn, transistor 87 drives LED 50 to produce a series of light pulses.

When integrated circuit 78 goes high, nand gate 78*a* goes low, and nand gate 78*b* goes high. The high from nand gate 78*b* is connected to both nand gate 89 and nand gate 80. With a high into nand 80, its output goes low, causing nand 81 to go high, nand 89 to go low, and nand 90 to go high. This high enables capacitor 88*a*. Each of integrated circuits 89 and 90 can be one-quarter of a quadruple 2-input positive nand gate with open collector output, such as a 74HC03.

The infrared light beam 50*a* from LED 50, since it is pulsed, is distinct from any stray infrared light which may be received by infrared sensor receiver 52 which can comprise a phototransistor. By way of example, phototransistor 52 can be a T1L414 phototransistor. When phototransistor 52 receives the pulsed infrared beam 50*a*, it holds capacitor 88*a* discharged by means of nand gates 89 and 90, and resistor 93.

If pulsed infrared beam 50*a* applied by LED 50 to phototransistor 52 is interrupted by the hand of a user being extended into the open cavity 46*q* of the modular frame as shown in FIG. 5, capacitor 88*a* commences to charge by means of resistor 93, The charging of capacitor 88*a* provides an input to pin 10 of nonretriggerable monostable multivibrator with clear, 96, which, by way of example, can be an 74HC221. In response to the input at pin 10, an output pulse at pin 5 is coupled to transistor 101 which is thereby turned on to drive motor 57.

The drive signal for motor 57 from pin 5 of monostable multivibrator 96 to transistor 101 is also coupled to pin 14 of a programmable modulo-N decade counter 102, which for example, can comprise a 74HC4017. Thus, the motor drive signal provides a clock input pulse to the decade counter 102 at pin 14. The output of the decade counter 102 is pin 3 which is normally high. When the clock input comes in, pin 3 goes low. By way of pin 9 of monostable multivibrator 103 connected to pin 3 of decade counter 102, the response to the clock input on pin 3 of decade counter 102 triggers a first monostable timer which is one-half of the retriggerable monostable multivibrator with clear 103, such, for example, a MM74HC221. The first timer has a period of approximately 5.6 seconds, for example.

During the time period when the first timer goes high, the decade counter 102 will count any input of motor drive pulses which it receives at pin 14. If the decade counter 102 receives more than, for example, three pulses in a predetermined period of time, such for example 5.6 seconds, during which the first timer is on, the decade counter 102 causes a second timer in monostable multivibrator 103 to fire. This second timer is the other half of monostable multivibrator 103. The second timer is fired by nand gate 104. Nand gate 104 can be one-quarter of a quadruple 2-input position nand gate, for example a 74HC03. Thus, pin 7 of decade counter 102 is connected to one input of nand gate 104 and pin 5 of monostable multivibrator 103 is connected to the other input of nanad gate 104. When nand gate 104 fires, it provides a delay pulse by means of the second timer of monostable multivibrator 103. Thus, the output of nand gate 104 is connected to pin 1 of monostable multivibrator 103.

The output of the second timer of multivibrator 103 at pin 4 is connected as an input along with the approach sensor input signal from comparator 78 into nand gate 78*a*. As a result, the second timer of monostable multivibrator 103 will provide a timing period delay of about fifteen seconds during which time the dispensing apparatus cannot be triggered. This time duration can be made to be adjustable. In this way, the dispensing device can be protected against improper use where a user would repeatedly interrupt the sensing beam 50*a* in a short period of time to cause a number of closely spaced dispensing cycles.

Monostable multivibrator 96 has a variable resistor or potentiometer 105 to enable the drive pulse to motor 57 to be adjusted in length and thereby the time duration of the dispensing cycle. Thus, by means of adjusting the time duration of the drive signal to motor 57, the duration of a dispensing cycle can be controlled. By way of example, a typical period for the drive signal of motor 57 can be selected to be from about one-half second to about one and one-half seconds. Similarly, the time cycle of each of the two timers of monostable multivibrator 103 can be provided with potentiometers for setting their respective time cycles.

In summary, when the input pulse to motor 57 goes high, pin 14 of the counter 102 also goes high. Pin 3 which is the zero output of the decade counter is normally high; however, it will go low when the counter 102 is pulsed at pin 14. When pin 3 goes low, the first timer of half of the monostable multivibrator 103 will go on for approximately 5.6 seconds. During this period that the first half is on, if the decade counter 102 receives more than three pulses at pin 14, pin 7 of the decade counter 102 will go high. When pin 7 of the decade counter 102 goes high, it is coupled through an open collector nand gate 104 to which is collected the first timer of multivibrator 103 having the 5.6 second time period. If both of those conditions occur, i.e., the inputs to nand gate 104 are both high at the same time, then the output of the nand gate 104 will go low and fire the second timer of monostable multivibrator 103 which is the delay timer. When the delay timer goes high, its output at pin 4 disables the approach sensor nand gate 78*a*. Thereafter, for a period of approximately fifteen seconds, the delay period, the dispensing unit cannot be actuated. At the end of fifteen seconds, the circuit resets back to normal and thereafter can be activated to dispense. Accordingly, abnormal use, i.e., excessive cycling of the dispenser is prevented and yet after the fifteen second delay period, the dispenser is reset for normal operation.

Switch 106 when it is in a grounded position, short circuits capacitor 107 and causes an input to nand gate 108 to go low. Nand gate 108 connects capacitor 107 to pin 15 of decade counter 102. The first timer of monostable multivibrator 103 can still go on, but with the output of nand gate 108 high, the decade counter reset remains high so it cannot count. Thus, the counter circuitry can be disabled by switch 106. This in turn prevents the shutting down of the dispensing apparatus even though a rapid series of interruptions of the infrared beam 50*a* are made at the open cavity 46*q* by a user.

Figure 7:
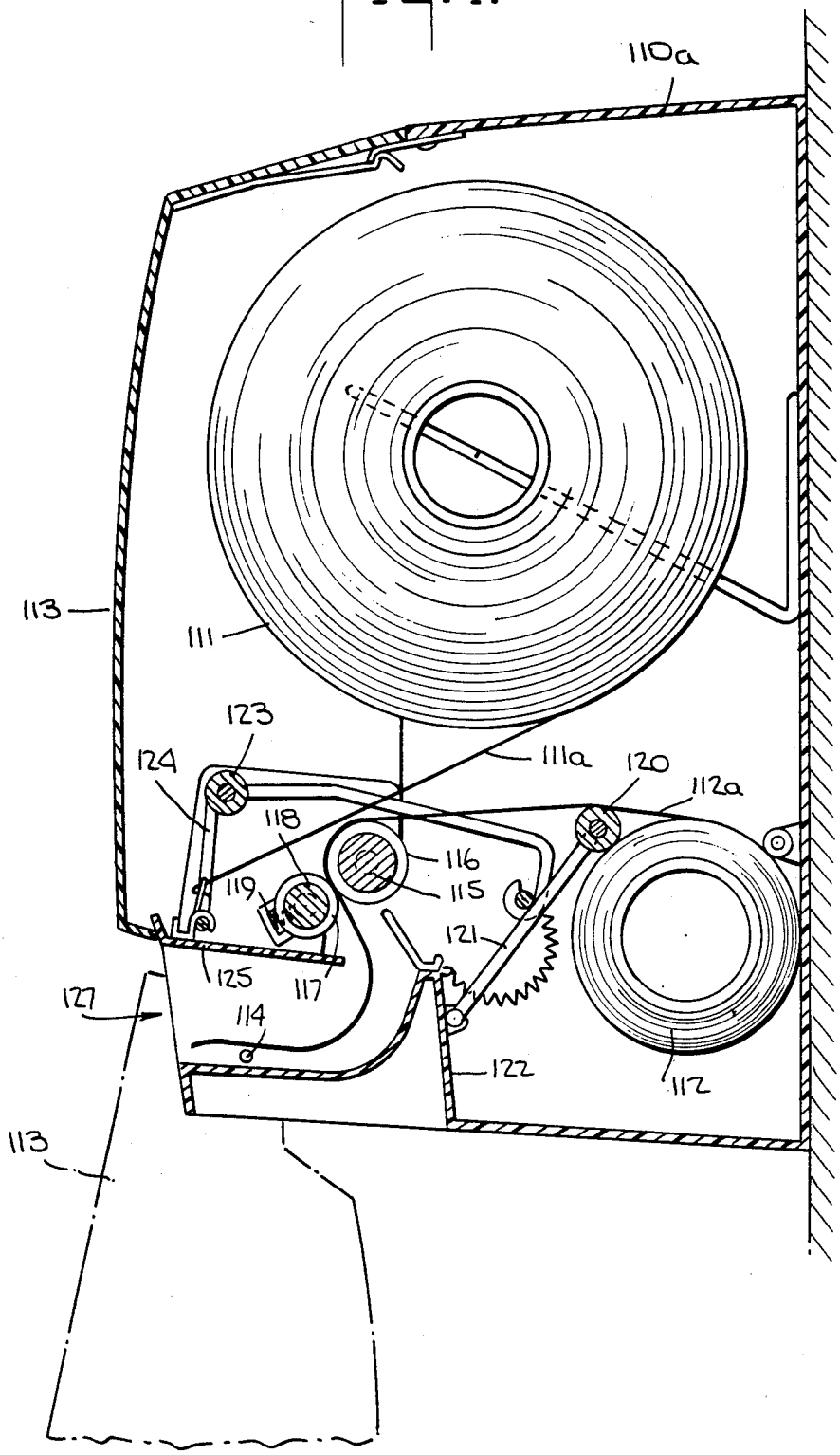
FIG. 7 is a vertical section view of the dispensing apparatus of the invention adapted to contain two rolls of paper towel material with a mechanism to deliver towel material first from one roll and thereafter the second roll.

In FIG. 7 there is shown dispensing apparatus 110 which comprises the apparatus of the dispensing apparatus 30 with the provision of two rolls 111 and 112 of sheet material such as paper towels within housing 110*a*. The dispensing apparatus 110 further includes cover 113 which is shown by dash lines in its open position and in solid lines in its closed position in FIG. 7. The cover can be pivoted about hinge 114. Dispensing apparatus 110 can utilize the elements of dispensing apparatus 30 for sensing the proximity of a user by electrical circuitry 48 including phototransistors 52 and 54. In addition, the dispensing apparatus 110 can employ a motor similar to motor 57 and gear transmission 59 to rotate drive shaft 115 and thereby drive roller 116 mounted thereon. Pressure roller 117 mounted on shaft 118 is biased by spring 119 toward drive roller 116.

An arrangement is shown in FIG. 7 for monitoring the diameter of roll 112 as the sheet material is drawn therefrom and to effect a transfer or removal of sheet material 112a from roll 112 when the diameter of roll 112 has been decreased to a minimum amount. The mechanism shown in FIG. 7 is similar to that shown in U.S. Pat. No. 3,628,743, issued Dec. 21, 1971, to Lehyman J. Bastian et al. Follower roller 120 is pivotally mounted on arm 121 which in turn is pivotally mounted on upright 122 of the housing 110*a* of the dispensing apparatus. When the diameter of the lower roll 112 reaches a predetermined minimum, the minimum diameter is detected by the travel of follower roller 121. Transfer roller 123 pivotally mounted on arm 124, which in turn is pivotally mounted on frame member 125, then swings in a clockwise direction in response to the movement in a clockwise direction of link 126 attached to arm 121. As a result, transfer roller 123 presses sheet material 111*a* from the upper roll 111 into contact with sheet material 112*a* being advanced from the lower roll 112. As a result, sheet material 111*a* is crowded into the nip between drive roller 116 and pressure roller 117. The sheet material 111*a* is then advanced along with the sheet material 112*a* to the discharge opening 127 of the dispensing apparatus. The dispensing of the two layers of sheet material 111*a* and 112*a* continues until the sheet material 112*a* on lower roll 112 is depleted. In this way it can be seen that the supply of sheet material within the dispensing apparatus can be substantially increased by the provision of two rolls and a mechanism to introduce the dispensing of a second roll of sheet material as the first roll of the sheet material is depleted.

Figure 8:
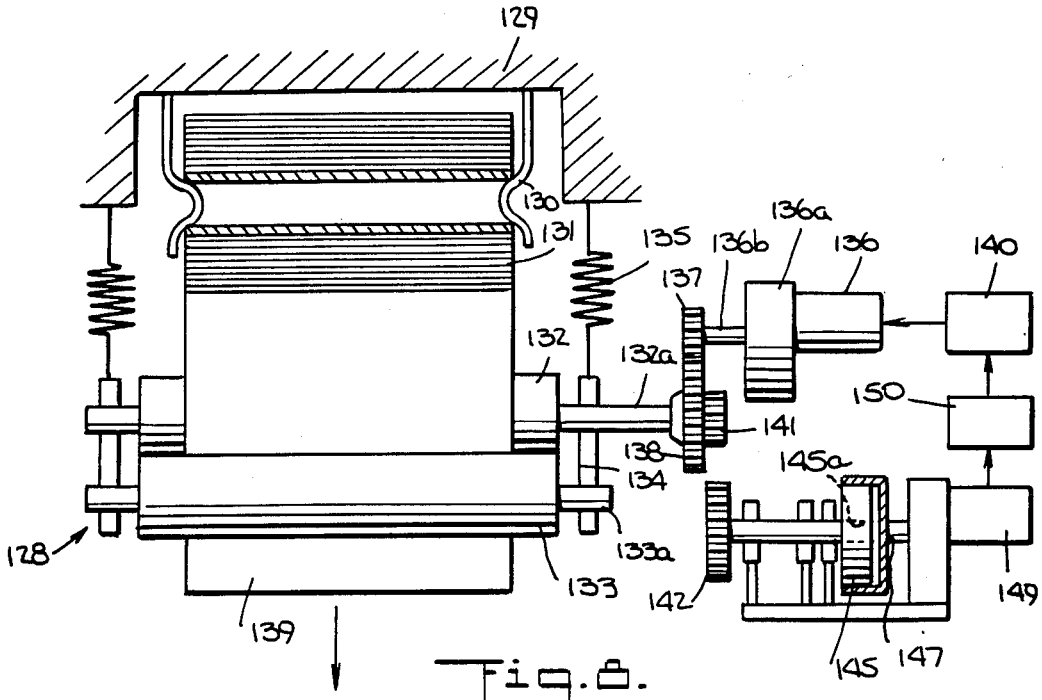
FIG. 8 is another embodiment of the dispensing apparatus of the invention in which movement of the drive roller as the user withdraws sheet material from the supply roll drives a generator which is connected to a battery power supply for energizing the dispensing apparatus.
Figure 9:
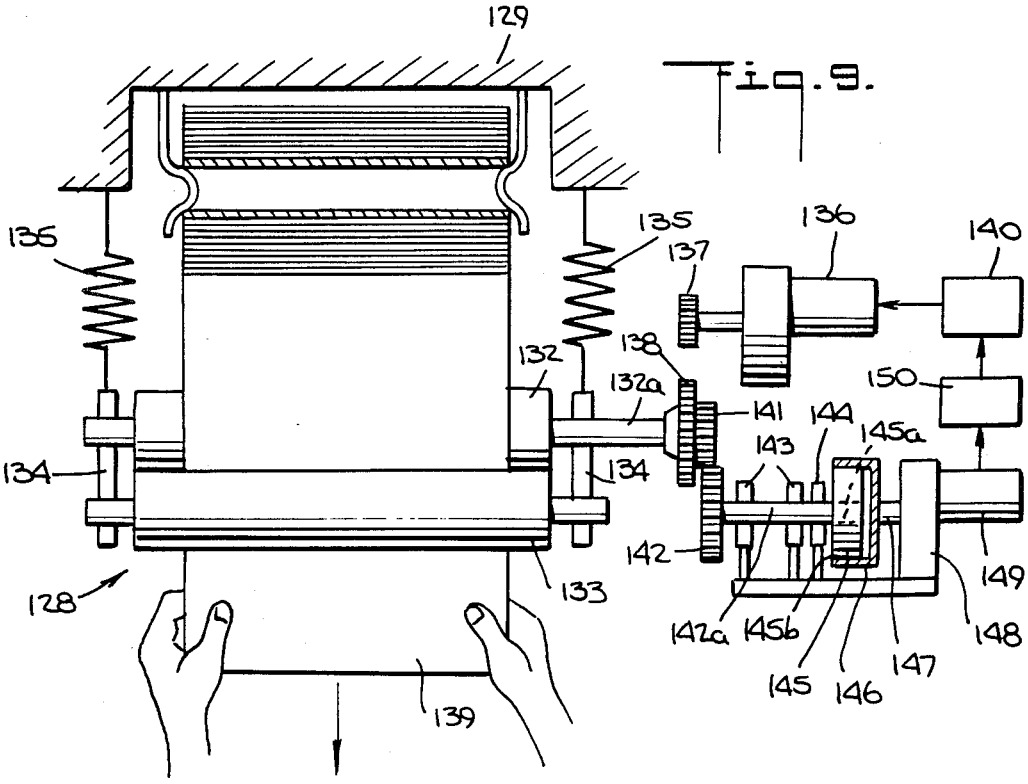

In FIG. 8 there is shown another embodiment of the invention, dispensing apparatus 128. The dispensing apparatus 128 includes housing 129 having supports 130 for roll 131 of sheet material such as paper towel material. The sheet material is extended between drive roller 132 and pressure roller 133 which is urged toward the drive roller by means not shown. Carriers 134 pivotally support shaft 132*a* of drive roller 132 and the shaft 133*a* of pressure roller 133. The carriers 134 are supported by springs 135 attached to housing 129.

Motor 136 has output shaft 136*a* connected to drive gear 137 which is engaged to driven gear 138 mounted on shaft 132*a* . Thus, it can be seen that motor 136 is adapted to rotate drive roller 132 and thereby advance tail 139 of sheet material, such as paper towel material, beyond the nip of rollers 132 and 133. The tail or edge portion 139 of the sheet material is available to be grasped by a user of the dispensing apparatus 110, thereby enabling the user to withdraw a length of the sheet material from the dispensing apparatus.

Electrical circuitry 140 connected to motor 136 can be similar to that of electrical circuitry 48 which is adapted to activate the means for advancing the sheet material in response to the proximity of a user to the dispensing apparatus. Thus, for example, circuit 140 can include a phototransistor for sensing a change in the ambient light due to the presence of a user or the hand of a user. Circuit 140 can also use a phototransistor and a source of infrared light such as that from a light-emitting diode for activating the dispensing apparatus, again in response to the presence of a user. Circuitry 140 when activated simply advances tail 139 of the sheet material for a predetermined time and is then deactivated, thereby presenting the tail of material to the user to be grasped by the user.

As shown in FIG. 9, downward force applied to tail 139 by the user causes a corresponding force to be applied to springs 135 which enable carriers 134 to move downwardly with respect to housing 129. As a result, drive gear 137 of motor 136 becomes disengaged from driven gear 138. At the same time, pinion 141 mounted on shaft 132*a* of drive roller 132 is carried into engagement by the downward movement of carriers 134 with driven gear 142 mounted on shaft 142*a*. The downward movement of tail 139 of the sheet material in response to force applied thereto by the user causes drive roller 132 to be rotated by engagement with the sheet material in a counterclockwise direction when viewed from the right of FIG. 9. In turn, the counterclockwise rotation of shaft 132*a* and pinion 141 rotates driven gear 142 and thereby shaft 142*a* in a clockwise direction. Shaft 142*a* which is supported by bearings 143 is coupled to detent or ratchet mechanism 144 which simply permits clockwise rotation of shaft 142 while preventing counterclockwise rotation thereof. Shaft 142*a* is coupled to clockspring 145 at the inner portion 145*a* of the clockspring while the outer portion 145*b* of the clockspring is coupled to housing 146, mounted on shaft 147. Shaft 147 is coupled to gear transmission 148 which has its output coupled to generator 149. Gear transmission 148 is adapted to be a step-up gear transmission in that the input speed on shaft 147 is increased at the output of gear transmission 148 where it is coupled to generator 149.

The withdrawing of tail 139 of the sheet material from dispensing apparatus 128 results in the rotation of pinion 141 which rotates gear 142 and shaft 142*a*. The rotation of 142*a* winds clockspring 145 with respect to housing 146 until a level is reached at which the torque applied by the clockspring 145 to housing 146 is sufficient to overcome the torque presented to shaft 147 and housing 146 by the static friction of the stationary gears of gear transmission 148. Thus, it can be seen that the removal of sheet material by the user rotates pinion 141 and thereby enables energy, i.e., mechanical energy to be stored by clockspring 145. When the torque developed in the clockspring by the drive of pinion 141 overcomes the static friction presented by gear transmission 148, the closkspring is then adapted to unwind and drive housing 146 in a clockwise direction as viewed from the right in FIG. 9, thereby driving generator 149 by means of gear transmission 148. The generator is driven at an increased speed in view of the step-up function of gear transmission 148. The output energy, i.e., the electrical energy, of generator 149 is stored in accumulator or battery 150. The battery 150 is the power source for circuit 140 and motor 136.

Upon completion of withdrawal of sheet material by the user from dispensing apparatus 128, the user releases the tail of the sheet material after tearing away the desired amount. As a result, the downward force applied to springs 135 is removed and the springs 135 return carriers 134 to the position shown in FIG. 8 in which driven gear 138 is reconnected to drive gear 137.

Figure 10:
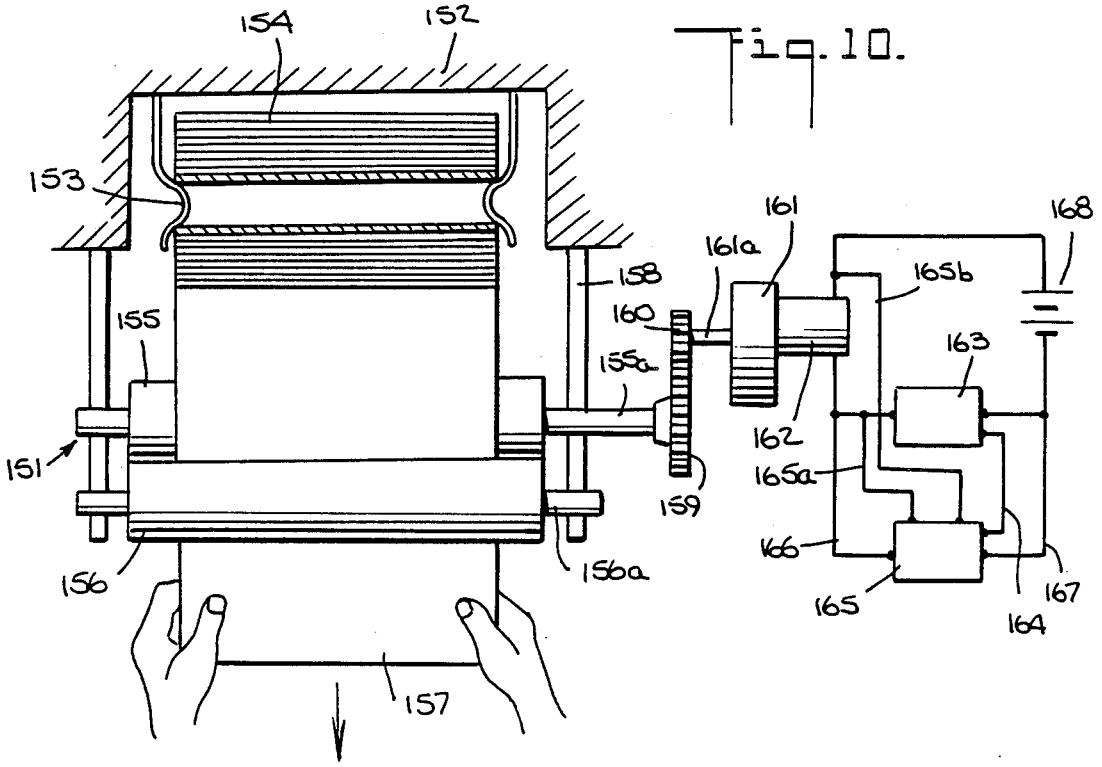
FIG. 10 shows still another embodiment of the dispensing apparatus of the invention in which the motor which dispenses a tail of sheet material in response to the proximity of the user is switched to serve as a generator when the user withdraws sheet material from the dispensing apparatus.

In FIG. 10 there is shown an additional embodiment of the invention, dispensing apparatus 151. The dispensing aparatus 151 includes housing 152 which supports retainers 153 for roll 154 of sheet material such as paper towel material. The sheet material from roll 154 extends through the nip of drive roller 155 and pressure roller 156 and then extends therebeyond in the form of tail 157. Shaft 155*a* of the drive roller 155 and shaft 156*a* of pressure roller 156 are pivotally supported by frame members 158 extending from housing 154. Gear 159 is meshed with gear 160 which is mounted on shaft 161*a* of gear transmission 161. Motor 162 is coupled to gear transmission 161. Electrical circuitry 163 is adapted to energize motor 162 in order to drive shaft 155*a* and the drive roller 155 to dispense tail 157 of sheet material in response to the proximity of a user to the dispensing apparatus 151. By way of example, electrical circuit 163 can be similar to electrical circuitry 48 which employs phototransistors 52 and 54 for sensing the proximity of a portion of a hand of a user to the dispensing apparatus. Once tail 157 has been dispensed, the timers of electrical circuitry 163 which are similar to those of electrical circuitry 48 terminate the energizing of motor 162.

Thereafter upon the user withdrawing sheet material from apparatus 151, the movement of the sheet material rotates drive roller 155 and thereby the gears 159 and 160. Gear 160 by way of shaft 161*a* drives gear transmission 161 and thereby motor 162. Circuitry 163 is connected by lead 164 to switching unit 165. When the timers of electrical circuitry 163 terminate the energizing of motor 162, switching unit 165 connects motor 162 by leads 166 and 167 as a generator across battery 168. Accordingly, the energy made available by the user in withdrawing the sheet material from roll 154 is utilized to drive motor 162 as a generator, thereby charging battery 168. Switching unit 165 by way of leads 165*a* and 165*b* senses the voltage developed across motor 162 when it is driven by gear transmission 161. Once the withdrawal of sheet material by the user is completed the rotation of drive roller 155 ceases and thereby the drive to motor 162. The resulting decline in voltage across motor 162 operating as a generator is sensed through leads 165*a* and 165*b* by switching unit 165 and causes the switching unit 165 to enable circuit 163 to drive motor 162 in response to the sensing of the proximity of a user to dispensing apparatus 151.

What is claimed is:

1. Apparatus for dispensing sheet material comprising:

structure forming a housing having a discharge opening;

means disposed within the housing for storing a supply of sheet material with a portion of the sheet material positioned within the housing adjacent the discharge opening;

advancing means disposed within the housing for advancing the sheet material through the discharge opening, said advancing means including an electric motor;

means for activating the advancing means for a predetermined period of time to advance a predetermined length of the sheet material through the discharge opening, said predetermined length of sheet material being grippable by a user to enable the user to withdraw a length of the sheet material from the dispensing apparatus;

means for enabling the activating means for permitting the activating means to supply electrical energy to the advancing means;

said enabling means and said activating means being associated with the housing and being responsive to the proximity of a portion of a hand of a user with respect to the housing without the user contacting the dispensing apparatus for enabling the activating means and thereafter activating the advancing means for advancing a predetermined length of the sheet material through the discharge opening; and means responsive to the withdrawal of sheet material by the user for storing energy to energize said electrical motor.

2. The apparatus of claim 1 further comprising means for converting the electrical motor into an electrical generator in response to the advancing of the sheet material through the discharge opening by the advancing means, the withdrawal of sheet material by the user through the discharge opening driving the motor converted by the converting means into a generator to thereby generate electrical energy.

3. The apparatus of claim 2 wherein said means responsive to the withdrawal of sheet material by the user through the discharge opening for storing energy stores said electrical energy generated by the motor converted by the converting means into a generator.

4. The apparatus of claim 1 wherein the means responsive to the withdrawal of sheet material by the user through the discharge opening for storing energy includes a means for storing mechanical energy in response to the withdrawal of sheet material by the user through the discharge opening, means for converting the stored mechanical energy to electrical energy and means for storing said electrical energy.

5. The apparatus of claim 1 wherein the means responsive to the withdrawal of sheet material by the user through the discharge opening for storing energy includes a battery.

6. Apparatus for dispensing sheet material, said apparatus including structure forming a housing having a discharge opening therein; means disposed within the housing for storing a supply of sheet material with an edge portion of the sheet material positioned within the housing adjacent the discharge opening; electrically energized advancing means for advancing the edge portion of the sheet material through the discharge opening to a position adjacent the exterior of the housing where the edge portion can be grasped by a user of the dispensing apparatus to enable the user to withdraw a length of the sheet material from the dispensing apparatus; characterized in that said apparatus includes means responsive to the proximity of a user with respect to the dispensing apparatus without the user contacting the dispensing apparatus for activating the advancing means; and means responsive to the withdrawal of sheet material by a user through the discharge opening for storing energy for electrically energizing the advancing means.

7. Apparatus in accordance with claim 6 characterized in that the means for storing energy for use in electrically energizing the advancing means includes means for storing mechanical energy in response to the withdrawal of sheet material by the user; means for converting the stored mechanical energy into electrical energy and means for storing said electrical energy for use in electrically energizing the advancing means.

8. Apparatus in accordance with claim 7 characterized in that the means for storing mechanical energy comprises a resilient element adapted to be deflected from a relaxed position to an energy storing position, and means for deflecting the resilient element from its relaxed position to its energy storing position in response to the movement of the sheet material upon being removed through the discharge opening by the user.

9. Apparatus in accrodance with claim 7 characterized in that the means for converting the stored mechanical energy into stored electrical energy comprises a generator, means connected to the generator for storing electrical energy generated thereby, and means for releasing the stored mechanical energy to the generator.

10. Apparatus in accordance with claim 9 characterized in that the electrically energized advancing means comprises a feed roller and an electric motor for rotating said feed roller, said electric motor being in circuit with the means connected to the generator for storing electrical energy generated thereby.

11. Apparatus in accordance with claim 10 characterized in that the electrically energized advancing further comprises a pressure roller disposed adjacent the feed roller and forming a nip with respect thereto, the sheet material when extending through the nip being pressed against the feed roller by the pressure roller.

12. Apparatus in accordance with claim 11 characterized by means for supporting the pressure roller adjacent the feed roller with a nip therebetween, and means for resiliently mounting the supporting means to enable the feed roller to be displaced from a feed position in response to the force applied to the sheet material when the user withdraws a length of sheet material from the dispensing apparatus, and means for coupling the feed roller to the electric motor only when the feed roller is in its feed position to enable the feed roller to be uncoupled from the electric motor when the feed roller is displaced from its feed position.

13. Apparatus in accordance with claim 12 characterized in that the means for coupling the feed roller to the electric motor comprises a transmission device having driving and driven elements connected in the feed position of the feed roller and separated when the feed roller is displaced from its feed position in response to the displacing of the feed roller by the mounting means.

14. Apparatus in accordance with claim 13 characterized in that additional means couples the feed roller to the generator when the means for resiliently mounting the supporting means enables the feed roller to be displaced from its feed position in response to force applied to the sheet of material when the user withdraws a length of sheet material from the dispensing apparatus.

15. Apparatus in accordance with claim 6 wherein the electrically energized advancing means includes an electrical motor and further comprising means for converting the electrical motor into an electrical generator in response to the advancing of the edge portion through the discharge opening by the electrically energized advancing means, the withdrawal of sheet material by the user through the discharge opening driving the motor converted by the converting means into a generator to generate electrical energy.

16. The apparatus of claim 6 wherein the means responsive to the withdrawal of sheet material by the user through the discharge opening for storing energy includes a battery.

* * * * *